US009694403B2

(12) United States Patent
Eckerstorfer et al.

(10) Patent No.: US 9,694,403 B2
(45) Date of Patent: Jul. 4, 2017

(54) REDUCTION OF THE STRIP TENSION OF ROLLING STOCK BETWEEN TWO ROLLING UNITS TO A MINIMUM

(75) Inventors: Gerald Eckerstorfer, Leonding (AT); Ansgar Grüss, Erlangen (DE); Otto Schmid, Röttenbach (DE)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 890 days.

(21) Appl. No.: 13/695,391

(22) PCT Filed: Apr. 18, 2011

(86) PCT No.: PCT/EP2011/056079

§ 371 (c)(1),
(2), (4) Date: Dec. 3, 2012

(87) PCT Pub. No.: WO2011/134811

PCT Pub. Date: Nov. 3, 2011

(65) Prior Publication Data

US 2013/0074557 A1 Mar. 28, 2013

(30) Foreign Application Priority Data

Apr. 30, 2010 (AT) ..... A 735/2010

(51) Int. Cl.
*B21B 37/50* (2006.01)
*B21B 37/52* (2006.01)
(Continued)

(52) U.S. Cl.
CPC ..... *B21B 37/50* (2013.01); *B21B 37/52* (2013.01); *B21B 37/58* (2013.01); *B65H 20/34* (2013.01);
(Continued)

(58) Field of Classification Search
CPC ..... B21B 37/54; B21B 39/04; B21B 39/084; B21B 39/16; B21B 37/00; B21B 37/48;
(Continued)

(56) References Cited

U.S. PATENT DOCUMENTS 2,394,824 A * 2/1946 Todd ..... 72/11.4
3,628,367 A * 12/1971 Wilg ..... 72/324
(Continued)

FOREIGN PATENT DOCUMENTS

AT 404682 B 12/1998
CN 2576364 Y 10/2003
(Continued)

OTHER PUBLICATIONS

International Search Report and Written Opinion, Application No. PCT/EP2011/056079, 10 pages, Oct. 18, 2011.
(Continued)

*Primary Examiner* — Jimmy T Nguyen
*Assistant Examiner* — Gregory Swiatocha
(74) *Attorney, Agent, or Firm* — Ostrolenk Faber LLP

(57) ABSTRACT

A method for reducing the strip tension of a rolling stock, may include: transporting the rolling stock using a roller table between two successive rolling units, wherein a rolling stock loop is formed in a depression in a section of the roller table between the two rolling units, the rolling stock loop being supported by the roller table at least in one off-center portion of the section, wherein the supporting line of the roller table in this portion corresponds to the catenary curve of the free span; measuring a loop depth of the rolling stock loop; calculating a desired value of the loop depth that corresponds substantially to the free span, e.g., depending on the material, thickness and temperature of the rolling stock; controlling the main drives and/or the gap adjustment of the rolling units based on the desired value and the measured
(Continued)

loop depth, such that the loop depth substantially corresponds to the desired value.

15 Claims, 8 Drawing Sheets

(51) Int. Cl.

| | |
|---|---|
| ***B21B 37/58*** | (2006.01) |
| ***B21B 39/02*** | (2006.01) |
| ***B21B 39/12*** | (2006.01) |
| ***B21B 41/00*** | (2006.01) |
| ***B21B 41/10*** | (2006.01) |
| ***B65H 20/34*** | (2006.01) |

(52) U.S. Cl.
CPC ..... *B21B 39/02* (2013.01); *B21B 39/12* (2013.01); *B21B 41/00* (2013.01); *B21B 41/10* (2013.01)

(58) Field of Classification Search
CPC ..... B21B 37/50; B21B 37/52; B21B 37/58; B21B 39/02; B21B 39/12; B21B 39/14; B21B 41/00; B21B 41/10; B21B 41/12; B21B 39/00; B21B 39/006; B21B 37/05; B21B 41/128; B65H 20/06; B65H 20/08; B65H 20/24; B65H 20/34
USPC ..... 72/250, 251, 205; 226/118.1, 118.2, 226/118.3
See application file for complete search history.

(56) References Cited

U.S. PATENT DOCUMENTS

| | | | | |
|---|---|---|---|---|
| 3,722,251 | A * | 3/1973 | Withrow | 72/294 |
| 3,811,304 | A * | 5/1974 | Gorker | 72/11.4 |
| 5,709,119 | A * | 1/1998 | Palzer | 72/250 |
| 5,794,473 | A * | 8/1998 | Palzer | 72/8.9 |
| 6,463,652 | B1 * | 10/2002 | Narushima | B21B 1/02 29/33 C |
| 8,676,371 | B2 | 3/2014 | Botta | 700/152 |
| 2005/0167076 | A1 * | 8/2005 | Hennig et al. | 164/476 |
| 2009/0044583 | A1 * | 2/2009 | Daube et al. | 72/12.3 |

FOREIGN PATENT DOCUMENTS

| | | | | |
|---|---|---|---|---|
| CN | 1633341 | A | 6/2005 | |
| CN | 101518787 | A | 9/2009 | |
| CN | 101687235 | A | 3/2010 | |
| DE | 4407981 | A1 | 9/1995 | B21B 37/00 |
| DE | 19543605 | A1 | 5/1997 | B21B 37/16 |
| JP | 55045585 | A | 3/1980 | B21B 37/00 |
| JP | 62034613 | A | 2/1987 | B21B 37/00 |
| JP | H 1-278905 | | 11/1989 | |
| JP | 7265930 | A | 10/1995 | B21B 37/00 |
| JP | 10-005807 | | 1/1998 | |
| KR | 20030017014 | | 3/2003 | |
| RU | 2048938 | | 11/1995 | |
| RU | 2126304 | | 2/1999 | |
| WO | 2011/134811 | A2 | 11/2011 | B21B 37/50 |

OTHER PUBLICATIONS

Chinese Office Action dated Mar. 5, 2014 corresponding to Chinese Application No. 201180021820.3 (5 pages).

* cited by examiner

REDUCTION OF THE STRIP TENSION OF ROLLING STOCK BETWEEN TWO ROLLING UNITS TO A MINIMUM

CROSS-REFERENCE TO RELATED APPLICATIONS

This application is a U.S. National Stage Application of International Application No. PCT/EP2011/056079 filed Apr. 18, 2011, which designates the United States of America, and claims priority to AT Patent Application No. A735/2010 filed Apr. 30, 2010, the contents of which are hereby incorporated by reference in their entirety.

TECHNICAL FIELD

The disclosure relates to a method and to an apparatus for reducing the strip tension of rolling stock to a minimum, wherein the rolling stock is transported, by means of a roller table, between two rolling units which are in engagement with the rolling stock.

Specifically, the disclosure relates to a method for reducing the strip tension of rolling stock to a minimum, comprising the following steps:

- transporting the rolling stock, by means of a roller table, between two rolling units which are in engagement with the rolling stock, wherein a rolling stock loop is formed in a depression arranged in a section of the roller table between the two rolling units;
- detecting a measured value of a loop depth of the rolling stock loop by means of a measuring device; and
- controlling the main drives of the rolling units by means of a control device taking the measured value of the loop depth into consideration, such that the strip tension is reduced to a minimum.

Furthermore, the disclosure relates to an apparatus for reducing the strip tension of rolling stock to a minimum, comprising:

- a roller table, which transports the rolling stock between two rolling units which are in engagement with the rolling stock;
- a control device, which controls the rolling units in such a way that a rolling stock loop is formed in a depression provided in a section of the roller table, the loop depth of which rolling stock loop corresponds substantially to the free span of the rolling stock in this section; and
- a measuring device for detecting a rolling stock loop, wherein the measured value of the measuring device can be forwarded to the control device and can be used for controlling the main drives of the rolling unit or the drivers.

BACKGROUND

During the production of a hot strip, the rolling is usually effected in rolling mills having a plurality of rolling units and rolling processes which are separated from one another. The rolling stock may come from a separate continuous casting device, for example. Each rolling process may proceed in this case in individual reversing stands, or may be effected in a plurality of rolling units which can each be assembled from a plurality of rolling stands. The rolls in these rolling stands are usually driven by drives, the rotational speed of which is predefined by a superordinate control device.

The rolling stock may also be a hot strip which is produced in a continuous process in a combined casting and rolling installation by an upstream continuous casting machine that is arranged, in particular, in-line.

In the case of such rolling mills, there is the problem that it is difficult in drive terms to precisely distinguish between the drive power which is required to deform the rolling stock and the drive power which is required for applying a strip tension and for conveying the hot strip. A rolling stand therefore cannot be operated as a drive element with controlled strip tension. The mass flow between successive rolling relays has to be decoupled.

In known installations for producing strip steel (conventional wide hot strip trains), this decoupling can be realized between two rolling relays in such a way that the fed material is divided into slabs, and the distances between the individual rolling relays (roughing stands and finishing train) are selected in such a way that both rolling relays are never in engagement with the same roughed strip at the same time. However, this results in a large structural length of the installation, causing high investment costs and thermal losses. As an alternative to this, the roughed strip split into pieces can also be coiled and uncoiled again in devices provided specifically for this purpose, but this is likewise associated with a corresponding outlay.

It is known that a minimum tension control can be effected either by direct tension control or by loop control for coupling two successively engaging rolling units. In both cases, a minimum strip tension is always required for control. However, this minimum required strip tension which is necessary for control and/or is available from tensile measured variables may exceed the yield point of the hot rolling stock to be machined. A material loop which hangs free in parts or entirely also forms an additional strip tension component by virtue of the dead weight. If the sum of the strip tension components locally exceeds the yield point of the rolling stock to be machined, a reduction in the quality and output of the end product produced is unavoidable. Constrictions over the width of the rolling stock and resultant remachining on the end product, in particular, lead to a considerable loss in the ratio between the material used and the material output.

JP 6234613 A has already disclosed an apparatus of the generic type and a method for reducing the strip tension of a rod-shaped long product to a minimum, said method having the following steps:

- transporting the rolling stock, by means of a roller table, between two rolling units which are in engagement with the rolling stock, wherein a free-hanging rolling stock loop is formed in a depression arranged in a section of the roller table between the two rolling units;
- detecting a measured value of a loop depth of the rolling stock loop by means of a measuring device; and
- controlling the main drives of the rolling units by means of a control device taking the measured value of the loop depth into consideration, such that the strip tension is reduced to a minimum.

As a result of the free-hanging rolling stock loop, however, a not inconsiderable strip tension is introduced into the rolling stock; particularly in the case of hot long products, as arise for example in the continuous production of strip steel in a combined casting and rolling installation, this can lead to constrictions and/or cracks in the strip. It is not clear from said document how the strip tension can be reduced further, or how the loop depth can be set, in particular dynamically for different operating conditions.

To avoid disadvantages of the prior art mentioned above, or else also for plants for continuously producing strip steel in a semi-continuous or continuous multi-stage hot-rolling method in which the roughing stand train and finishing train are connected to one another by a long roughed strip, a satisfactory solution for the decoupling of two successive rolling stages is not known to date.

SUMMARY

In one embodiment, a method for reducing the strip tension of rolling stock to a minimum may comprise the following method steps: transporting the rolling stock, by means of a roller table, between two rolling units which are in engagement with the rolling stock, wherein a rolling stock loop is formed in a depression arranged in a section of the roller table between the two rolling units, and the rolling stock loop is supported by the roller table at least in one off-center portion of the section, wherein the supporting line of the roller table in this portion corresponds to the catenary curve of the free span; detecting a measured value of a loop depth of the rolling stock loop by means of a measuring device; calculating a desired value of the loop depth, in particular depending on the material, thickness and temperature of the rolling stock, such that the desired value corresponds substantially to the free span; and controlling the main drives and/or the gap adjustment of the rolling units by means of a control device taking the desired value and the measured value of the loop depth into consideration, such that the loop depth corresponds as far as possible to the desired value.

In a further embodiment, the product formed from the length of the rolling stock loop, the loop depth and the thickness of the roughed strip is selected to be between $2*10^5$ $mm^3$ and $6*10^7$ $mm^3$. In a further embodiment, the distance between an imaginary horizontal pass line and the vertex of the rolling stock loop is between 10 mm and 100 mm, e.g., between 15 mm and 60 mm. In a further embodiment, the main drives of the rolling units and/or drivers, which may be present, are controlled in such a way that the vertex of the rolling stock loop is held at a distance of between 10 mm and 50 mm, e.g., between 15 mm and 30 mm, from a roller of the roller table which is assigned to the vertex. In a further embodiment, each axis of each roller in the section is arranged at an equidistant distance from the supporting line in the roller table. In a further embodiment, the vertical arrangement of a roller with respect to an entry plane and/or with respect to an exit plane is set by means of a drive apparatus. In a further embodiment, the form of the rolling stock loop is predefined in such a way that a gravitation loop is formed in a region. In a further embodiment, the width of the rolling stock before and/or within or after the section is detected metrologically by means of a rolling stock measuring device and the measured value is forwarded to the control device. In a further embodiment, the control device determines a control variable for controlling the rolling units from the fed measured value of the width of the rolling stock and a desired roll gap.

In another embodiment, an apparatus for reducing the strip tension of rolling stock to a minimum may comprise: a roller table, which transports the rolling stock between two rolling units which are in engagement with the rolling stock; a control device, which controls the rolling units in such a way that a rolling stock loop is formed in a depression provided in a section of the roller table, the loop depth of which rolling stock loop corresponds substantially to the free span of the rolling stock in this section; and a measuring device for detecting a rolling stock loop, wherein the measured value of the measuring device can be forwarded to the control device and can be used for controlling the main drives of the rolling unit or the drivers, wherein the roller table forms a support for the rolling stock loop in at least one off-center portion of the section, wherein the supporting line of the roller table in this portion corresponds to the catenary curve of the free span.

In a further embodiment, the depression is formed by an arrangement of rollers of the roller table, wherein, as seen in the transporting direction, rollers having a progressively decreasing diameter and then rollers having a progressively increasing diameter are arranged in the section. In a further embodiment, the depression is formed by a section in which a roller table segment can be lowered vertically by means of a controlled drive unit. In a further embodiment, the depression is formed by a section in which at least one roller table segment can be pivoted about an associated pivot axis by means of a controlled drive unit. In a further embodiment, the rolling stock loop has a vertex and the rollers are arranged symmetrically with respect to a vertical which passes through the vertex. In a further embodiment, a rolling stock measuring device is provided for metrologically detecting a width of the rolling stock before and/or within or after the section and the measured value can be forwarded to the control device.

BRIEF DESCRIPTION OF THE DRAWINGS

Example embodiments will be explained in more detail below with reference to figures, in which.

DETAILED DESCRIPTION

Figure 1:
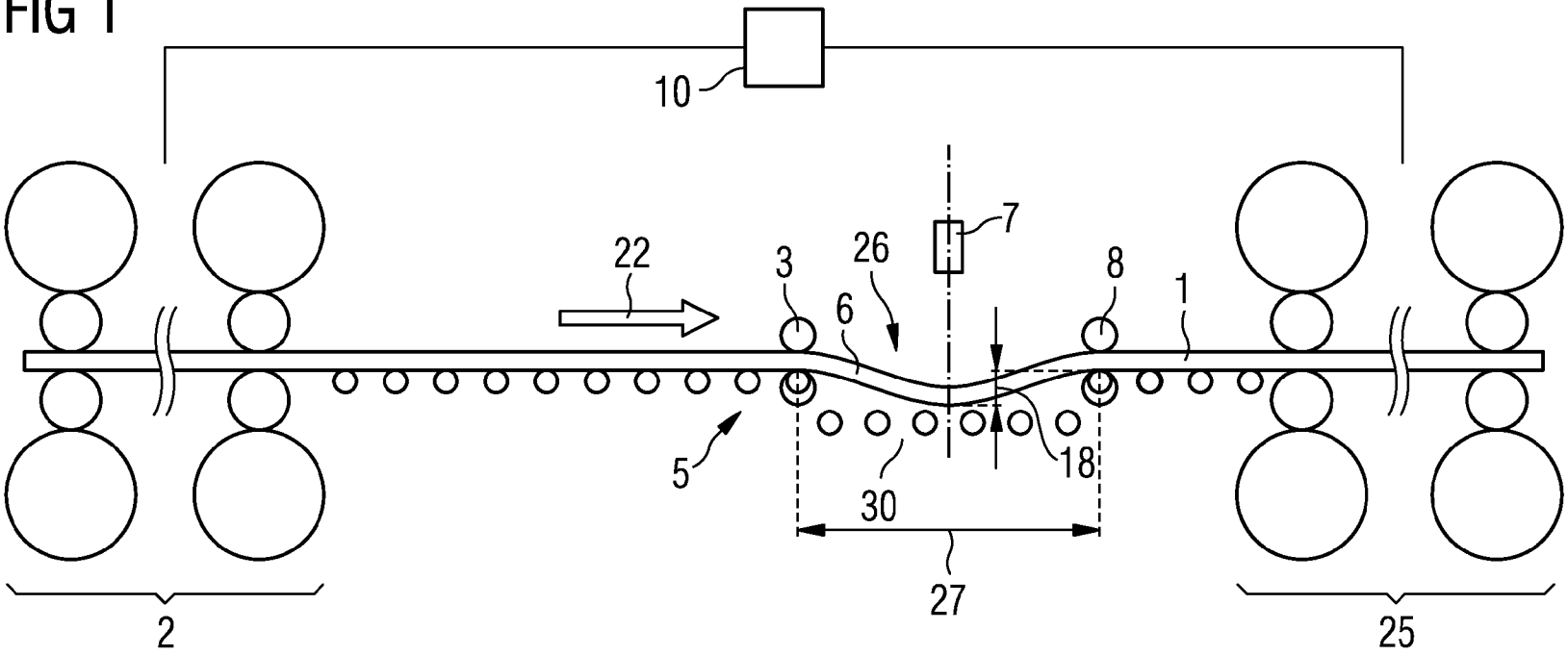
FIG. 1 shows an exemplary embodiment with a free-hanging rolling stock loop.

Some embodiments provide a method and an apparatus which make it possible for the strip tension of rolling stock between two successive rolling units to be reduced to a minimum, or to be completely avoided, in a simple manner.

Aspects of certain embodiments are based on the knowledge that the tensile forces acting on the rolling stock can be reduced to a minimum or eliminated by providing a depression in the conveying path between two successive rolling units controlled by a control device along a section. A rolling stock loop is formed in this depression, the loop depth of which rolling stock loop is kept at a value by the control device which corresponds to the free span of the rolling stock in this section. The span is dependent substantially on the material, on the cross-sectional form and on the temperature of the rolling stock. According to some embodiments, the desired value of the loop depth depending on the material (e.g. the chemical composition), the cross-sectional form (e.g. the actually arising thickness and width of the rolling stock) and the temperature are calculated in real time and to take this as a basis for the control as a reference variable. Furthermore, the rolling stock loop may be supported at least outside a central portion which is associated with the vertex of the rolling stock loop, so that the effective longitudinal extent of the rolling stock loop and therefore the tensile stresses which arise in the rolling stock can be reduced to a value of virtually zero.

In one embodiment of the method, the product formed from the length of the rolling stock loop, the loop depth and the thickness of the roughed strip is kept at a value of between $2*10^5$ $mm^3$ and $6*10^7$ $mm^3$.

One embodiment may provide for the transporting device to be formed by a roller table which at the same time forms a support for the rolling stock loop. In the case of this support, the rolling stock loop is supported at least at one point of a supporting line which is predefined by the line of curvature of the free span of the rolling stock in the section to be bridged. The individual supporting elements lie underneath the main transporting line (pass line) of the rolling stock. They may be arranged on a supporting line which runs parallel or equidistantly to the elastic line of the free span, i.e. it is curved or bent to the same extent. This has the effect that the rolling stock is inlaid in this depression on account of its dead weight, and virtually tension-free "embedding" in said depression occurs. This has the effect that no inadmissibly high tensile loading acts on the rolled strip in a rolling mill even in the case of continuous production. During the production, the width tolerance and the cross-sectional tolerance can thereby be observed better. There are no longer any undesirable constrictions or even a crack in the rolling stock. In the case of an exemplary use in a combined casting and rolling installation, the casting process is less exposed to negative influences from the rolling process.

In one embodiment of the method, the main drives of the rolling units and, if appropriate, also the drivers are controlled in such a way that the vertex of the rolling stock loop is held at a distance of between 10 mm and 50 mm, e.g., between 15 mm and 30 mm, from a roller of the roller table which is assigned to the vertex.

One embodiment of the method may provide for each axis of a roller to be arranged at an identical distance from the supporting line in the roller table. The rolling stock loop thereby lies in a virtually tension-free manner in this "roller bed".

It may be favorable if individual rollers of the roller table can be adjusted in height by means of a lifting and lowering apparatus or if an entire roller table segment can be adjusted in height by means of a drive apparatus. This makes it easier to thread in the strip head. If the individual rollers of a roller table can be displaced in the vertical position thereof by separate drives, the supporting line can be adapted very well to mechanical bending properties of the rolling stock. The strip tension is virtually zero both in the depression and in the immediate vicinity thereof, upstream and downstream. There are hardly any disruptive tensile and mass flow fluctuations from the rolling mill into the region of the casting installation. Depending on the material property, it may be advantageous if the rolling stock loop is pressed downward at the entry and/or at the exit of the depression by means of a pressure roller.

It may be favorable if the control device predefines a form of the "roller table loop" where only a very short free-hanging loop portion is formed. This has the effect that a disruptive weight force of the sagging loop hardly ever arises. In the rolling mill, the strip tension is then virtually zero upstream, downstream and in the "roller table loop".

In order to detect the loop depth of the rolling stock loop, it is possible to use various measuring devices, for example contactless or contacting measuring devices known per se. The measured value of the loop depth is forwarded to the control device. A model and control algorithm is implemented in the control device. By taking the loop depth into consideration, the control device can determine appropriate corrections for the rolling speed depending on the rolling process and predefine the feeding and/or discharging rolling units. Fluctuations in the mass flow at the input or at the output of the roller table are gathered by a change in the loop depth promptly, e.g., in real time, and can therefore be compensated for directly.

Other embodiments provide an apparatus of the generic type, in which the roller table forms a support for the rolling stock loop in at least one off-center portion of the section, wherein the supporting line of the roller table in this portion corresponds to the catenary curve of the free span.

One embodiment may be designed in such a way that the transporting device is a roller table which forms a support for the rolling stock loop in the depression. The depression is formed by an arrangement of rollers of the roller table, wherein, as seen in the transporting direction, rollers having a progressively decreasing diameter and then rollers having a progressively increasing diameter are arranged in the section.

Another embodiment may be designed in such a way that the depression of the transporting device is formed by two adjoining portions of the transporting device, i.e. two pivotable roller table segments. The construction may be such that the roller table portions can each be pivoted about a pivot axis arranged at an end lying remote from the point at which the segments abut. In this way, it is likewise possible for a deepened section to be produced in the horizontal transporting plane of the conveying device, in which a loop-like formation of the rolling stock is possible. The support may be provided again on the supporting line and relieves the loop from the dead weight.

In practical use, it may be advantageous if the vertex of the rolling stock loop is held at a distance of less than 50 mm from an opposite roller in the lowered roller portion by means of the control device.

FIG. 1 shows a feeding rolling unit 2 and a discharging rolling unit 25, which are each in engagement with rolling stock 1, according to an example embodiment. The rolling units 2, 25 are controlled by a control device 10. A transporting or conveying device 5 in the form of a roller table is shown between the two rolling units 2, 25. This roller table 5 has a section 27, in which a lowerable roller table segment 30 is shown. When the rolling stock 1 is being introduced, this roller table segment 30 is flush with the transporting or conveying plane. During the rolling, in which both the rolling unit 2 and the rolling unit 25 are in engagement with the rolling stock 1, the roller table segment 30 is lowered downward for decoupling the rolling units 2, 25, such that a rolling stock loop 6 is formed in the depression 26. As explained in more detail hereinbelow, the loop depth 18 of this rolling stock loop 6 is controlled in such a way that it corresponds to the free span in the section 27. Here, free span is to be understood as meaning the span of a portion of the rolling stock 1 which is cut free at both ends and is supported at each end without friction.

Figure 2:
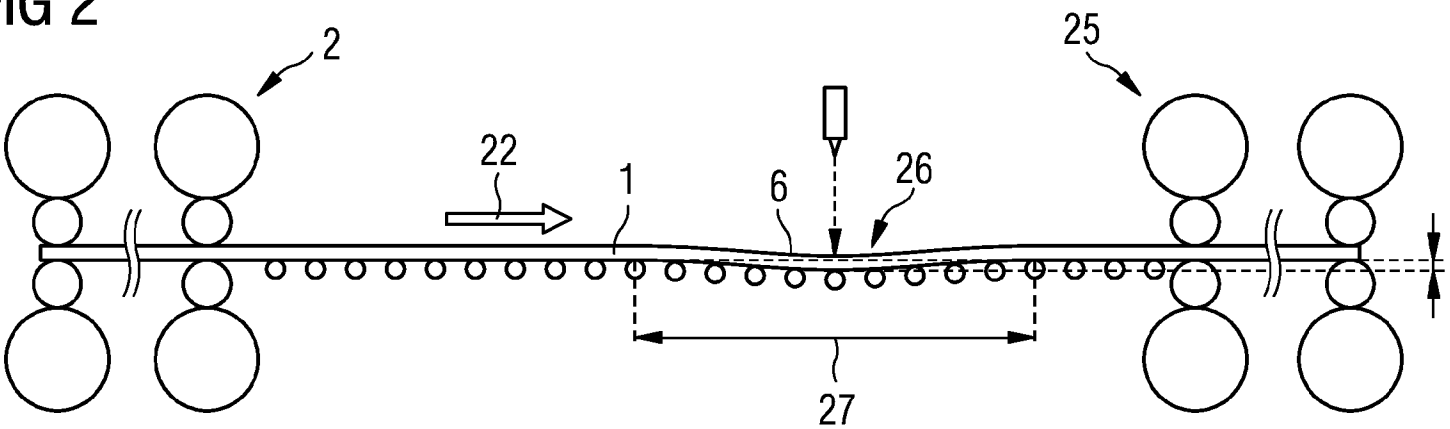
FIG. 2 shows an exemplary embodiment in which the rolling stock loop is embedded in a roller bed.

FIG. 2 likewise shows a transporting depression between two rolling units 2, 25 in engagement with the rolling stock 1. In contrast to FIG. 1, here the depression 26 is formed in such a way that the rolling stock loop 6 is supported by the rollers. The supporting line again corresponds to the free span. This span in the portion 27 is dependent substantially on the thickness, the temperature and the material of the rolled strip 1. In the exemplary embodiments discussed here, the thickness of the rolled strip 1 is approximately between 8 mm and 20 mm.

Figure 3:
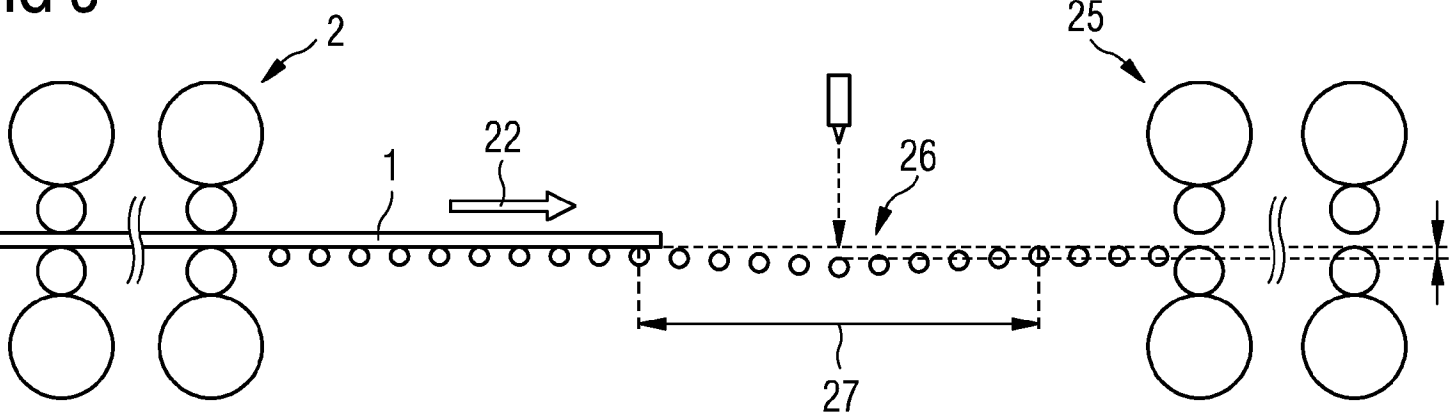
FIG. 3 shows the arrangement shown in FIG. 2, where only the feeding rolling unit is in engagement with the rolling stock.
Figure 4:
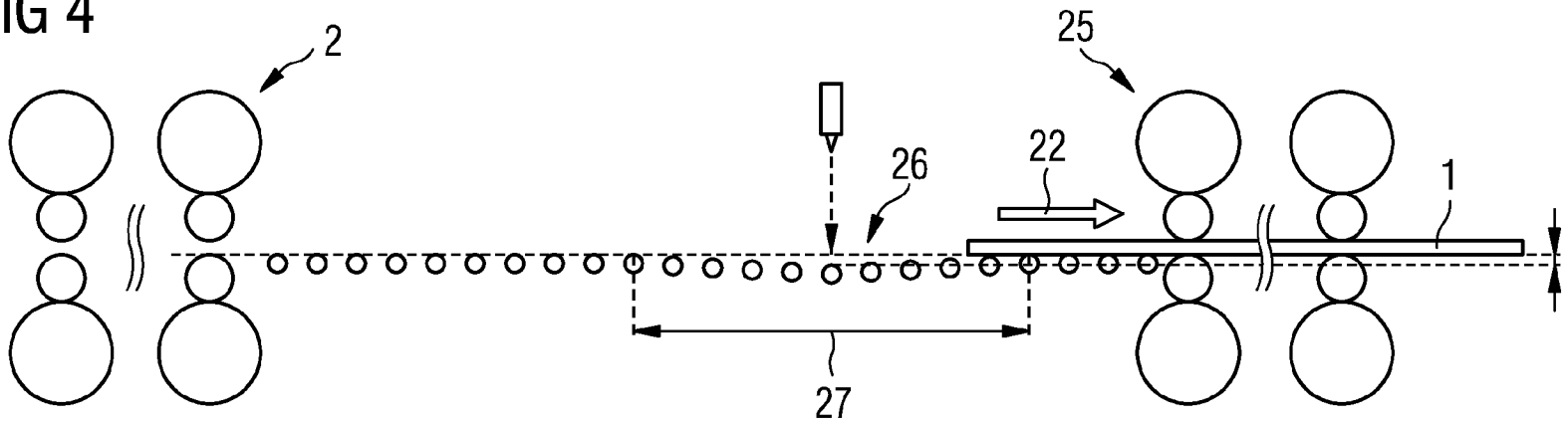
FIG. 4 shows the arrangement shown in FIG. 2, where only the discharging rolling unit is in engagement with the rolling stock.

FIG. 3 and FIG. 4 each show an uncoupled discrete operation of the rolling units 2, 25, where in FIG. 3 the rolled strip 1 enters the transporting depression 26 and in FIG. 4 it leaves it again.

Figure 5:
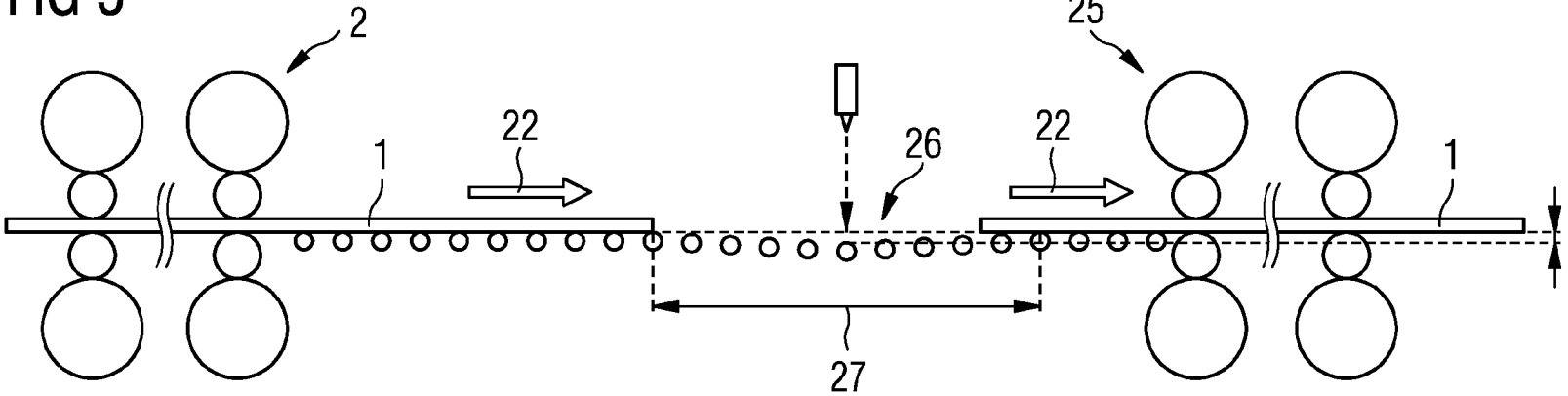
FIG. 5 shows the arrangement shown in FIG. 2, where both the feeding and the discharging rolling units are each in engagement with rolling stock.

FIG. 5 shows the uncoupled simultaneous operation of the rolling units 2, 25, wherein an outgoing rolled strip is in engagement with the rolling unit 25 and an incoming rolled strip is in engagement with the feeding rolling unit 2.

Figure 6:
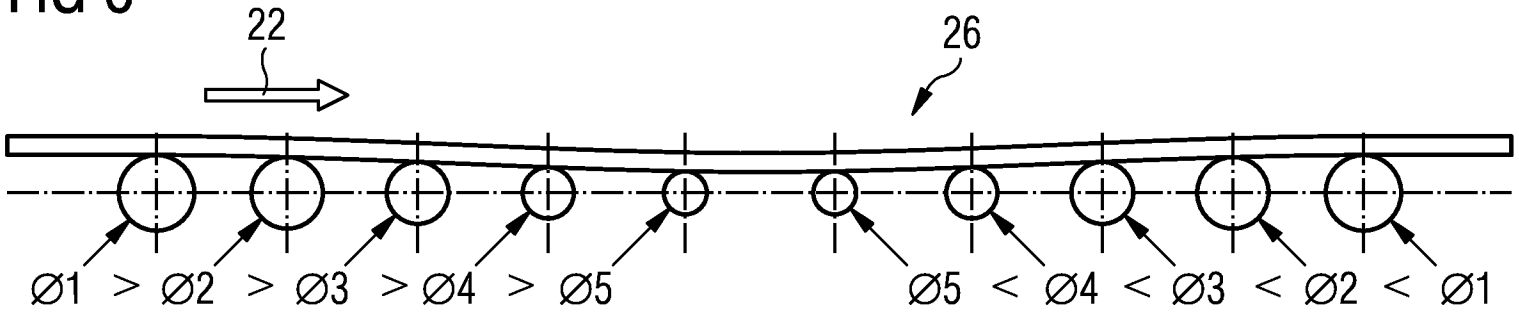
FIG. 6 shows a further exemplary embodiment, in which the depression is formed by rollers having a diameter which, as seen in the transporting direction, firstly decreases and then increases again.

FIG. 6 shows another possible embodiment. The transporting depression 26 is formed by virtue of the fact that a section 27 is formed by rollers, the diameter of which firstly decreases and then increases again, as seen in the transporting direction. This forms a deepened section in the conveying plane. The rolling stock loop lies in this deepened section and is supported from below. The support is effected on a supporting line which is predefined by the connecting line of the points of contact of the rollers in this portion. The supporting line may be formed according to the flexural rigidity of the rolled strip.

Figure 7:
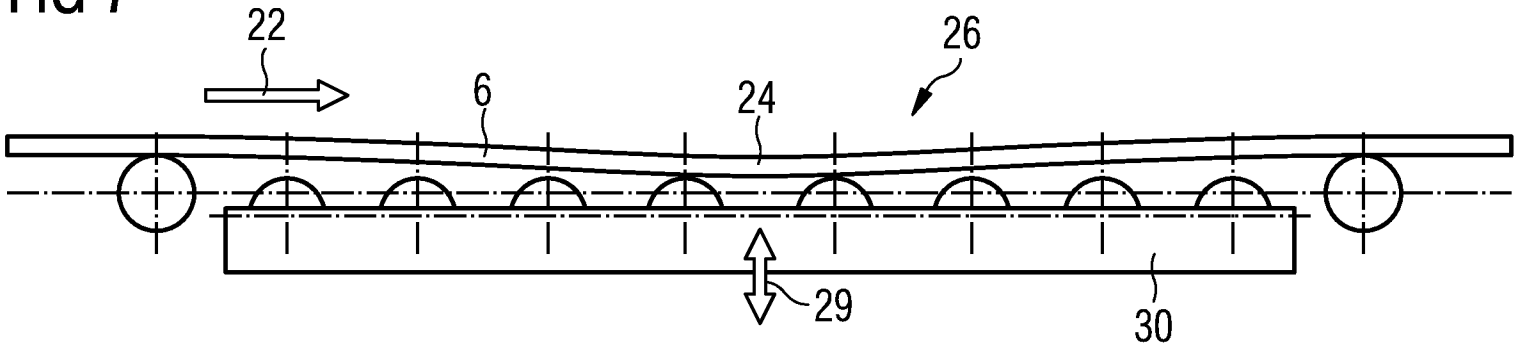
FIG. 7 shows a further embodiment with a vertically lowerable roller segment.

FIG. 7 shows another possible embodiment of the apparatus. Here, a roller table segment 30 can be lowered with respect to the conveying plane by means of an adjusting apparatus 29 (not shown in more detail here). The roller table segment can be lowered to the extent that a free-hanging loop is formed, or—as shown in FIG. 7—only to the extent that the vertex 24 of the rolling stock loop 6 is supported.

Figure 8:
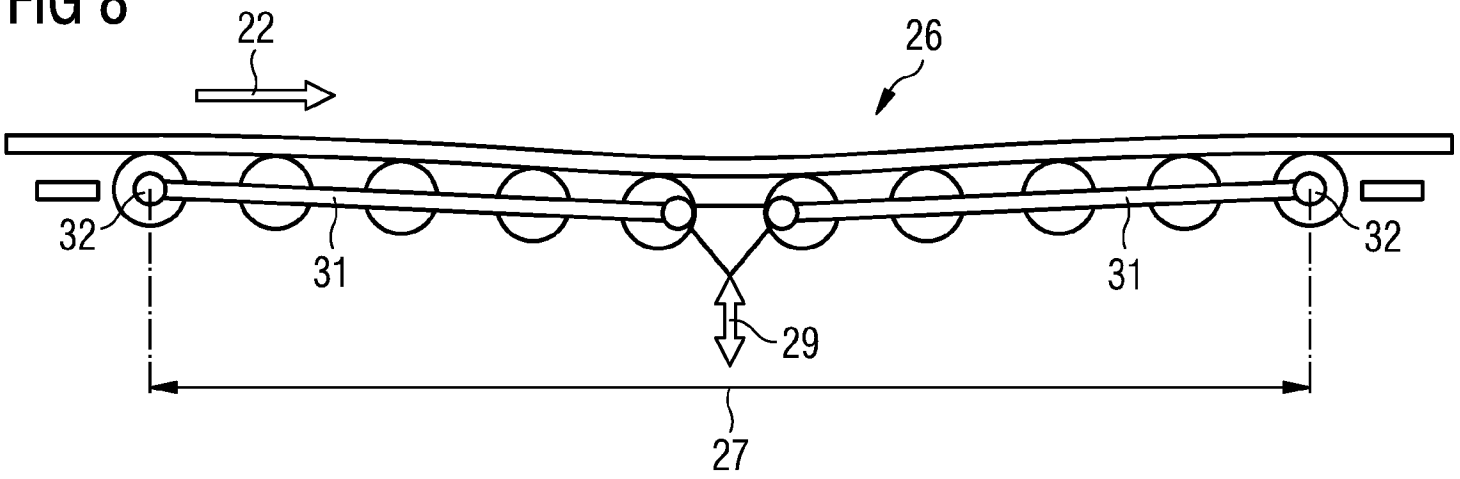
FIG. 8 shows a further embodiment with two pivotable roller table segments.

FIG. 8 outlines a further embodiment of the apparatus. The deepened section in the transporting plane is formed here by portions 31 of the roller table which can each be pivoted downward about the axes 32 by means of the adjusting apparatus 29.

Figure 9:
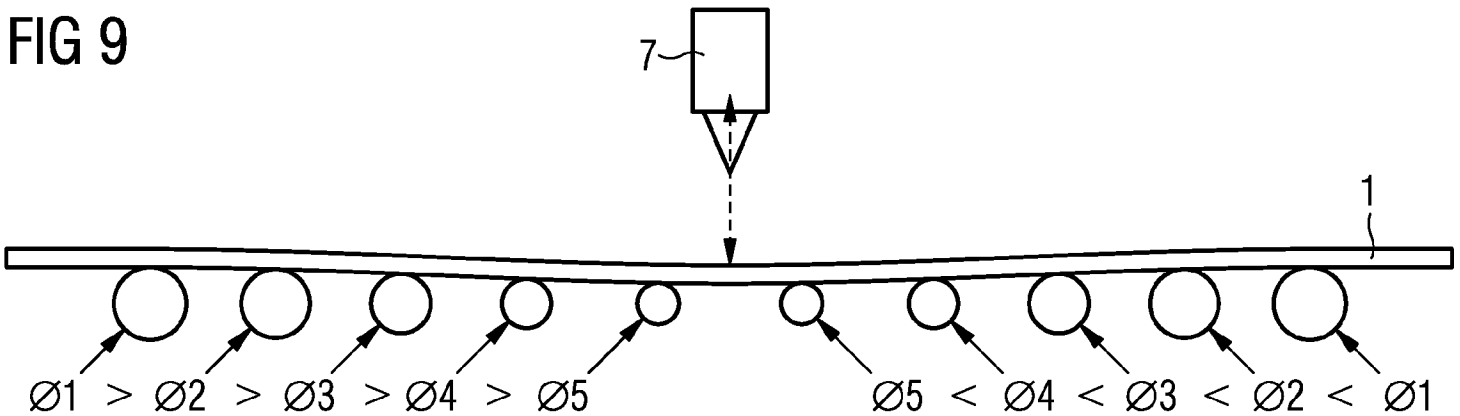
FIG. 9 shows an exemplary embodiment in which the depth of the loop in the depression is detected by means of a distance measuring device.
Figure 10:
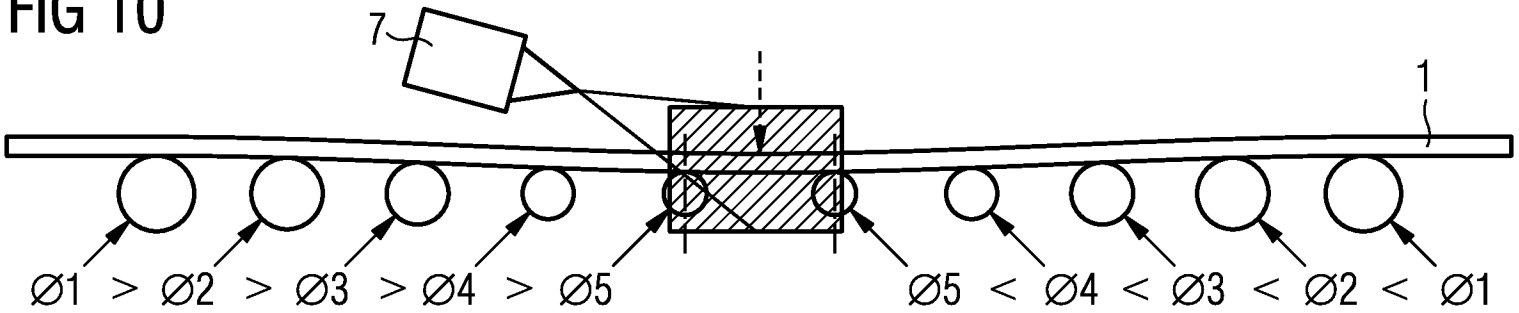
FIG. 10 shows an exemplary embodiment in which the depth of the loop in the depression is detected by means of a camera device.
Figure 11:
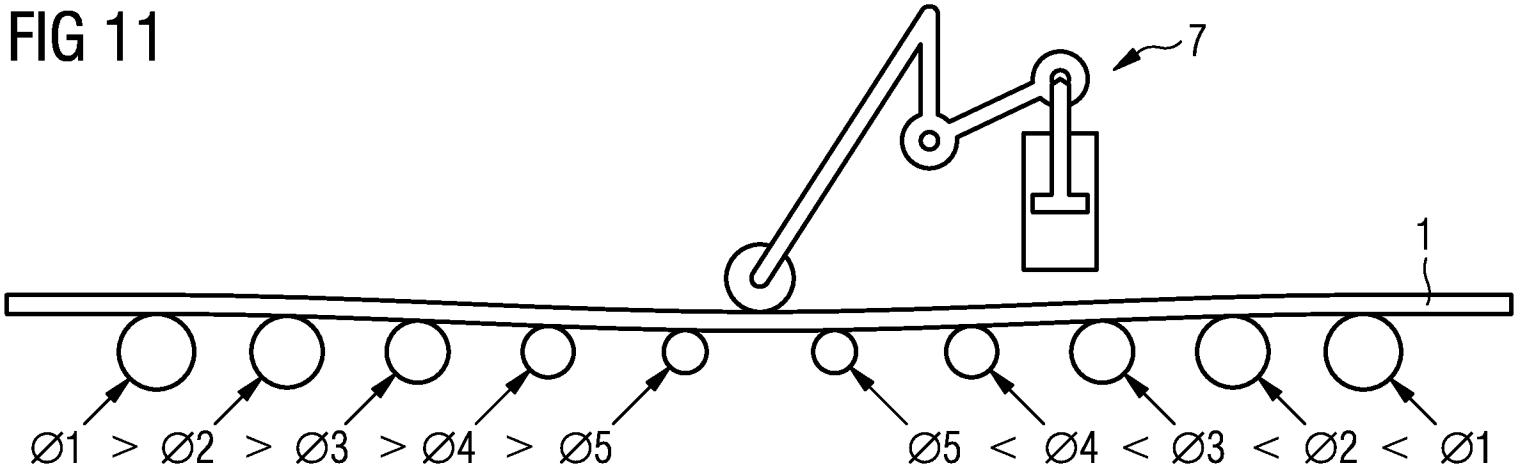
FIG. 11 shows an exemplary embodiment in which the depth of the loop in the depression is detected by means of a contacting measuring device in conjunction with a rotational angle measurement and/or position measurement.

The measuring device 7 for measuring the loop depth 18 can be provided, for example, by means of a distance measurement (FIG. 9), a camera system (FIG. 10) or else by means of a roller, which contacts the rolled strip from above, in conjunction with a rotational angle measurement or position measurement (FIG. 11). The contacting roller may at the same time be in the form of a press-down roller which, in addition to the measurement of the loop depth 18, at the same time contributes to the fact that the loop is pressed downward into the deepened section. It is self-evident that the measurement methods shown here can also be arranged underneath the rolled strip 1 or at the side.

Figure 12:
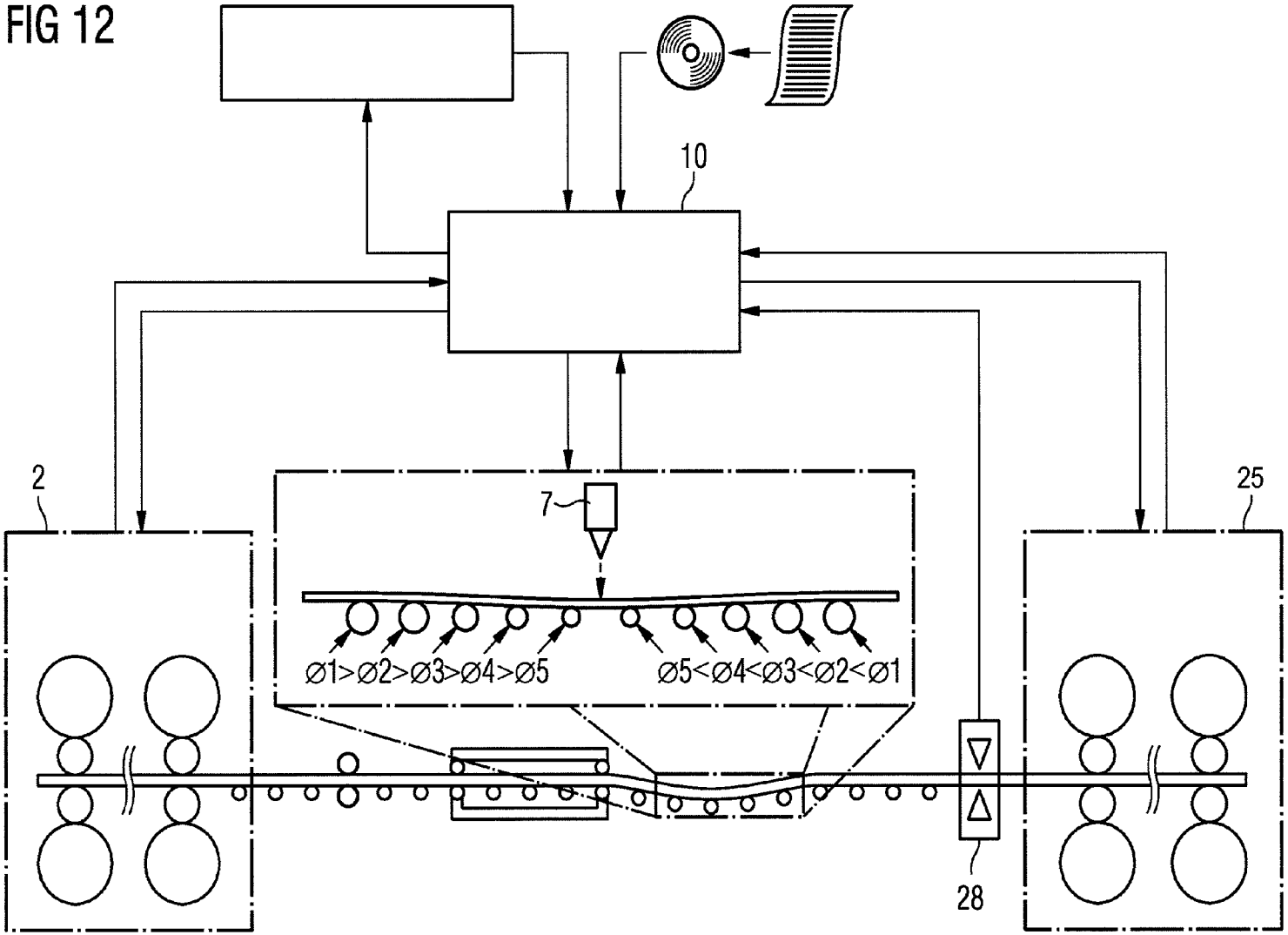
FIG. 12 shows a block diagram showing the integration of the control device in superordinate production planning.

FIG. 12 shows a block diagram showing the integration of the control device 10 in superordinate production planning with symbolically denoted background memories. Large distances between two successive rolling units to be decoupled, and also possibly intermediate rolling stock processing apparatuses, such as for example strip partition apparatuses, strip elongation apparatuses and/or a strip heating apparatus, may make it necessary to install appropriate sets of driving rollers. This is shown in FIG. 12. The sets of driving rollers shown are designed in such a way that the entry-side sets of driving rollers orient the rolling stock in the direction of the feeding rolling unit, and the outlet-side sets of driving rollers orient the rolling stock in the direction of the discharging rolling units. FIG. 12 outlines a typical arrangement with a strip heating device, in which the section of the rolling stock with the lowest tensile and/or flexural rigidity, in the case of hot strip the hottest section, determines the optimum position and configuration of the transporting depression.

Figure 13:
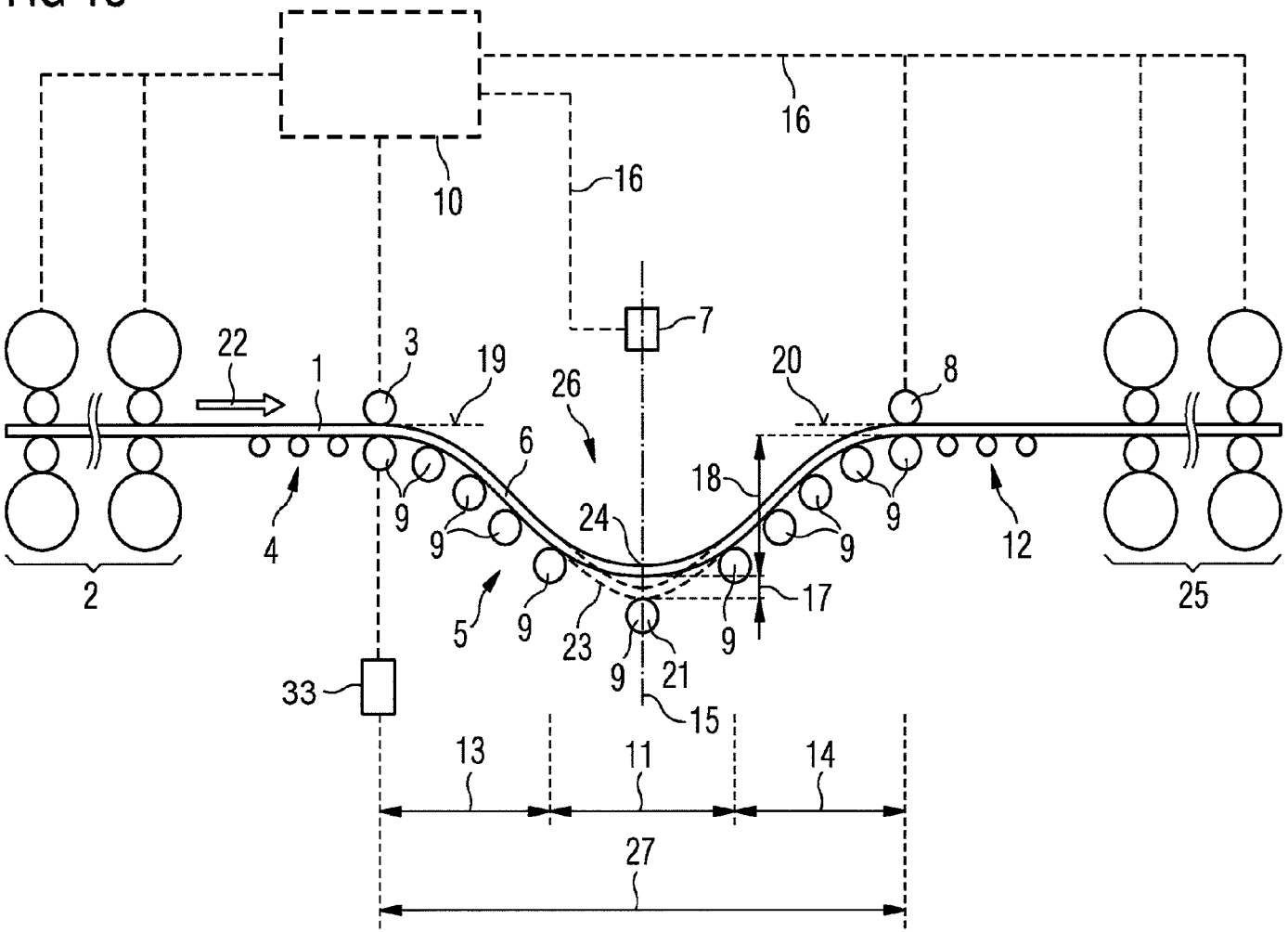
FIG. 13 shows an exemplary embodiment in which the rolling stock loop is supported by rollers of a roller table which can each be adjusted in height by means of an associated drive apparatus.

FIG. 13 shows an embodiment of the apparatus in which the vertical arrangement of the rollers of the transporting device is selected in such a way that the points of contact between the rolling stock and the roller each lie on the supporting line which corresponds to the line of curvature, also called the catenary curve, of the free span of the rolling stock in the section 27. FIG. 13 shows two rolling relays, a relay of roughing stands 2 and a relay of finishing rolling stands 25, the rolling speed of which is predefined by the control device 10. The rolling stock 1 is a hot strip. The arrow 22 indicates the direction of the mass flow. When the rolling stock 1 leaves the last rolling stand of the roughing stand relay 2 at a high temperature of usually more than 1100° C., it is particularly susceptible to tensile loading. In the case of a hot strip, an excessively high strip tension can lead to undesirable constrictions in roughed strips, as a result of which the width tolerance can no longer be observed. In an extreme case, this roughed strip may also be ripped or even severed during the production process. As already mentioned at the outset, the speed of the two rolling units or rolling stages 2, 25 therefore has to be controlled in a manner decoupled from one another, since it is not possible to simultaneously also operate a rolling stand as elements with controlled strip tension. "Speedmaster" in the case of such installations is the casting installation (not shown in more detail in FIG. 13) which lies upstream of the rolling unit 2.

The decoupling of the mass flow is achieved by the depression 26, which has a much smaller depth compared to a loop in a strip accumulator. What is known as a "roller table loop" is formed in said depression 26, i.e. the hot strip is guided in a supportive manner for as long as possible. Only in a short section 11 in the middle can a gravitation loop be formed during the control of the mass flow. It has been realized that virtually no strip tension acts on the rolling stock 1 by virtue of such a "roller table loop".

In FIG. 13, the hot strip 1 firstly passes through a number of roughing stands 2. Approximately on the exit plane 19 of the last rolling stand of the roughing stand 2, a roller table 4 conveys the rolled strip 1 to a first driver 3. After the driver 3, the rolling stock 1 passes into the roller table 5, which is configured as disclosed herein. This roller table 5 is not planar, but instead is lowered downward with respect to the exit plane 19 of the roughing stands 2 into a depression 26. The lowering of the rolling stock 1 can simply be caused by gravity, but may also be enforced, in particular in the case of thick rolling stock, by a press-down roller. After it has been lowered, the hot strip 1 is guided back up in the roller table 5. The rolling stock loop 6 has a continuous curvature in this case. The rolling stock 1 exiting the depression 26 at the end of the roller table 5 then passes to a second driver 8, which lies approximately on the entry plane 20 of a second roller table 12. Then, the rolling stock 1 enters the finishing train 25.

When it enters the finishing train 25, the hot strip 1 may still be at a temperature of up to 1250° C. As already mentioned, this high temperature makes the hot strip 1 sensitive to tensile loading. The control device 10 ensures that the speeds are decoupled, such that virtually zero strip tension prevails in the roller table 5.

The rotational speed of the rollers of the drivers 3, 8 is controlled precisely by the control device 10 in such a way that, in a stationary state, the mass flow is kept constant, but temporary fluctuations are absorbed by the loop-like form of the hot strip 1. The hot strip 1 either bears against all rollers 9 of the roller table 5, in contact therewith, or is lifted slightly from the supporting rollers in a central region 11 of the depression 26, in that a gravitation loop is formed there by controlling the rotational speed of the rolling stand main drives or of the driver roller drives.

As is evident from FIG. 13, the axes of the rollers 9, which each lie on a line running parallel to the supporting line 23, are arranged symmetrically with respect to a vertical 15. This gives rise to a rolling stock loop 6 which is substantially symmetrical with respect to the vertical 15. The supporting line 23 corresponds to the catenary curve of the free span.

In the example shown, the form of the rolling stock loop 6 is detected by means of a contactless measuring device 7. This is an optical detector here, but may also have a different form, as already mentioned above. The detector 7 in this case measures the loop depth 18, or the distance between the vertex 24 of the rolled strip loop 6 and a roller 21 lying opposite the vertex 24. The measured value of the detector 7 is forwarded to the control device 10 via connection lines 16. The control device 10 is likewise connected via connection lines 16 to the rolling stands of the rolling relay 2 and the rolling stands of the finishing relay 25, and also to the drivers 3, 8. It controls said drive unit in such a way that the arc of the rolling stock loop 6 is either supported completely on the rollers 9 of the roller table 5, or is lifted slightly from underlying rollers 9 in the vertex region. A distance of less than 30 mm is particularly favorable in this respect. If the area surrounding the vertex 24 of the loop 6 is lifted from the supporting rollers 9, a gravimetric loop part, which is kept as short as possible by the control device 10, is formed in the region 11. In other words, the rolling stock loop 6 is in touching contact with the rollers 9 virtually over the entire conveying section as a result of the sensitive control. The control device 10 ensures that portions 13 and 14 are much larger than the central portion 11, and thereby ensures that the strip tension between the rolling stands of the rolling relay 2 and the rolling stands of the finishing relay 25 or between the drivers 3, 8 is reduced to a minimum as desired.

As a result, effectively only a very small membrane stress acts on the roughed strip 1. An undesirable change to the shape of the rolled strip 1, such as constrictions or even cracks, can thus be reliably prevented in the continuous production of strip steel.

The vertical position of the rollers 9 in the roller table 5 can be fixedly predefined, or can be set separately by a drive apparatus 33 (sketched in FIG. 13) assigned to the respective rollers 9 (for example one drive apparatus per roller).

If the dead weight of the roughed strip is not sufficient for it to be gravitationally lowered in the roller table 5 (which may be the case for thick strips or slabs), a pressure roller (not shown in FIG. 13) acting from above downward can press the rolling stock into the deepened section of the roller loop pit.

The present invention may be advantageous, e.g., in the case of installations which are operated continuously or infinitely (combined casting and rolling installations with continuous strip production), since no possibility for satisfactory speed decoupling has been known to date for this type of installation.

LIST OF REFERENCE SIGNS

1 Rolling stock, hot strip
2 Feeding rolling unit, roughing stands
3 Driver
4 Roller table at the output of the roughing stands 2
5 Transporting device, roller table
6 Rolling stock loop, roller table loop
7 Measuring device
8 Driver
9 Rollers of the roller table 5
10 Control device
11 Central region, gravitation loop
12 Roller table at the input of the finishing relay 25
13 Entry portion
14 Exit portion
15 Vertical
16 Electrical connection lines
17 Distance
18 Loop depth
19 Exit plane
20 Entry plane
21 Roller, lying opposite 24
22 Arrow (mass flow direction, transporting direction)
23 Supporting line
24 Vertex
25 Exit-side rolling unit, finishing stands
26 Depression in the roller table 5
27 Section, length of the rolling stock loop
28 Rolling stock measuring device
29 Adjusting apparatus, lifting and lowering apparatus
30 Roller table segment
31 Roller table segment
32 Drive apparatus

What is claimed is:

1. A method for reducing the strip tension of rolling stock to a minimum, comprising:

using a first roller table, comprising a first plurality of rollers, to transport the rolling stock between two rolling units engaged with the rolling stock, wherein a rolling stock loop is formed in an entire length of a depression arranged in a section of the first roller table between the two rolling units, the section of the first roller table comprising a second plurality of rollers, the first plurality of rollers comprising the second plurality of rollers, a first end of the depression being located at a first driver roller and a second end of the depression being located at a second driver roller, wherein the rolling stock loop is supported by the first roller table in at least one portion of the section which does not include the center of the section, and wherein a supporting line of the rolling stock in the at least one portion is a cross-section of a lower surface of the rolling stock, the supporting line corresponding to a catenary curve of a free span of the rolling stock, the supporting line contacting at least one of the first plurality of rollers;

detecting a measured value of a loop depth of the rolling stock loop using a measuring device;

calculating a desired value of the loop depth such that the desired value corresponds to the free span; and using a control device to control at least one of: (1) a main drive of the rolling units, (2) a gap adjustment of the rolling units, and (3) at least one of the first driver roller and the second driver roller, based at least on the desired value and the measured value of the loop depth, such that the loop depth corresponds to the desired value, wherein the second plurality of rollers comprises at least one roller located in a portion of the section which includes the center of the section and which is adjacent to the portion of the section which does not include the center of the section, the second plurality of rollers forming the depression, the rolling stock loop contacts the second plurality of rollers and has a point on a top surface of the rolling stock at the bottom of the rolling stock loop and the second plurality of rollers are arranged symmetrically with respect to a line which is perpendicular to a tangent to the rolling stock loop, the tangent to the rolling stock loop passing through the point on the top surface of the rolling stock at the bottom of the rolling stock loop, the line which is perpendicular to the tangent to the rolling stock loop passing through the point on the top surface of the rolling stock at the bottom of the rolling stock loop, the rolling stock loop being symmetrical with respect to the line which is perpendicular to the tangent of the rolling stock loop, and the second plurality of rollers comprises a roller under the bottom of the rolling stock loop.

2. The method of claim 1, wherein a product of the length of the rolling stock loop, multiplied by the loop depth multiplied by the thickness of the rolling stock is selected to be between $2*10^5$ $mm^3$ and $6*10^7$ $mm^3$.

3. The method of claim 1, comprising controlling at least one of the main drive of the rolling units and a driver such that a point on a top surface of the rolling stock at the bottom of the rolling stock loop is held at a distance of between 10 mm and 50 mm from a top of a roller located at a distance from one of the rolling units equal to a distance of a point on a bottom surface of the rolling stock at the bottom of the rolling stock loop from the one of the rolling units.

4. The method of claim 3, wherein a central axis of each roller in the section is arranged at an equidistant distance from the supporting line of the rolling stock.

5. The method of claim 3, comprising using a drive apparatus to set the vertical position of at least one roller of the second plurality of rollers with respect to at least one of an entry plane of a second roller table and an exit plane of a last rolling stand of one of the two rolling units.

6. The method of claim 3, wherein the rolling stock loop is arranged such that a gravitation loop is formed in a central region of the section.

7. The method of claim 1, comprising measuring a width of the rolling stock metrologically by a measuring device, and transmitting a value of the measured width to the control device by a connection line connecting the measuring device to the control device.

8. The method of claim 7, comprising using the control device to control the rolling units based on the measured value of the width of the rolling stock and at least one desired value of a gap between the rolling stock and at least one roller in a central region of the section.

9. An apparatus for reducing the strip tension of rolling stock to a minimum, comprising:

a roller table, comprising a first plurality of rollers, configured to transport the rolling stock between two rolling units engaged with the rolling stock;

a control device programmed to control the rolling units such that a rolling stock loop is formed in an entire length of a depression provided in a section of the roller table, the section of the roller table comprising a second plurality of rollers, the first plurality of rollers comprising the second plurality of rollers, a first end of the depression being located at a first driver roller and a second end of the depression being located at a second driver roller, a loop depth of which rolling stock loop being equal to a free span of the rolling stock in the section;

a measuring device configured to measure the loop depth of the rolling stock loop, and transmit the measured value of the loop depth to the control device by a connection line connecting the measuring device to the control device, the control device being programmed to control at least one of: (1) a main drive of the rolling units, (2) a gap adjustment of the rolling units, and (3) at least one of the first driver roller and the second driver roller, based at least on the measured loop depth of the rolling stock loop, wherein the roller table forms a support for the rolling stock loop in at least one portion of the section which does not include the center of the section, and wherein a supporting line of the rolling stock in the at least one portion of the section is a cross-section of a lower surface of the rolling stock, the supporting line corresponding to a catenary curve of a free span of the rolling stock, the supporting line contacting at least one of the first plurality of rollers, the second plurality of rollers comprises at least one roller located in a portion of the section which includes the center of the section and which is adjacent to the portion of the section which does not include the center of the section, the second plurality of rollers forming the depression, the rolling stock loop contacts the second plurality of rollers and has a point on a top surface of the rolling stock at the bottom of the rolling stock loop and the second plurality of rollers are arranged symmetrically with respect to a line which is perpendicular to a tangent to the rolling stock loop, the tangent to the rolling stock loop passing through the point on the top surface of the rolling stock at the bottom of the rolling stock loop, the line which is perpendicular to the tangent to the rolling stock loop passing through the point on the top surface of the rolling stock at the bottom of the rolling stock loop, the rolling stock loop being symmetrical with respect to the line which is perpendicular to the tangent of the rolling stock loop, and the second plurality of rollers comprises a roller under the bottom of the rolling stock loop.

10. The apparatus of claim 9, wherein, in a transporting direction of the rolling stock, the second plurality of rollers comprises rollers having a progressively decreasing diameter and then rollers having a progressively increasing diameter.

11. The apparatus of claim 9, comprising a controlled drive unit configured to vertically lower a roller table segment to form the depression.

12. The apparatus of claim 9, comprising at least one roller configured to be pivoted about an associated pivot axis to form the depression.

13. The apparatus of claim 9, comprising a rolling stock measuring device configured to metrologically detect a width of the rolling stock, the value of which measured width being transmitted to the control device by a connection line connecting the rolling stock measuring device to the control device.

14. The method of claim 1, comprising calculating the desired value of the loop depth based at least on a material, a thickness, and a temperature of the rolling stock.

15. The method of claim 1, comprising controlling at least one of the main drive of the rolling units and a driver such that a point on a top surface of the rolling stock at the bottom of the rolling stock loop is held at a distance of between 15 mm and 30 mm from a top of a roller located at a distance from one of the rolling units equal to a distance of a point on a bottom surface of the rolling stock at the bottom of the rolling stock loop from the one of the rolling units.

* * * * *